US012808191B2

(12) United States Patent
Daysh

(10) Patent No.: US 12,808,191 B2
(45) Date of Patent: Nov. 24, 2026

(54) REBAR POSITIONING DEVICE

(71) Applicant: Daysh Developments, Inc., Benicia, CA (US)

(72) Inventor: Paul Daysh, Concord, CA (US)

(73) Assignee: Daysh Developments, Inc., Benicia, CA (US)

( * ) Notice: Subject to any disclaimer, the term of this patent is extended or adjusted under 35 U.S.C. 154(b) by 112 days.

(21) Appl. No.: 18/661,493

(22) Filed: May 10, 2024

(65) Prior Publication Data

US 2024/0376715 A1 Nov. 14, 2024

Related U.S. Application Data

(60) Provisional application No. 63/465,781, filed on May 11, 2023.

(51) Int. Cl.
*E04C 5/20* (2006.01)
*E04C 5/16* (2006.01)

(52) U.S. Cl.
CPC ..... *E04C 5/205* (2013.01); *E04C 5/16* (2013.01)

(58) Field of Classification Search
CPC ..... E04C 5/205; E04C 5/16
See application file for complete search history.

(56) References Cited

U.S. PATENT DOCUMENTS

| | | | | |
|---|---|---|---|---|
| 2,292,655 | A * | 8/1942 | Poston | E04C 5/18 52/688 |
| D452,135 | S | 12/2001 | Wyatt et al. | |
| D522,849 | S * | 6/2006 | Dick | D8/356 |
| 2007/0044423 | A1 | 3/2007 | Funk | |
| 2007/0295872 | A1 * | 12/2007 | Schulze | E04C 5/205 29/897 |
| 2012/0247057 | A1 * | 10/2012 | Alfonso | E04C 5/203 52/677 |
| 2019/0048555 | A1 * | 2/2019 | Jahnke | E02D 27/08 |
| 2020/0407987 | A1 * | 12/2020 | Vitale, Jr. | E04G 17/12 |
| 2021/0047832 | A1 * | 2/2021 | Giles | E02D 31/08 |

FOREIGN PATENT DOCUMENTS

| | | | | |
|---|---|---|---|---|
| JP | H0821098 A * | 1/1996 | | |
| WO | WO-2008131166 A1 * | 10/2008 | | E04C 5/205 |

* cited by examiner

*Primary Examiner* — Brian E Glessner
(74) *Attorney, Agent, or Firm* — Brian Beverly; Beeson Skinner Beverly, LLP

(57) ABSTRACT

A rebar positioning device has a generally planer shape and includes top and bottom cross bars and left and right side bars forming a generally rectangular profile. Upwardly extending upper left, upper right, lower left and lower right channels are formed in upper and lower portions of the device, each channel sized to receive a length of rebar to hold and position the rebar in the interior openings of a row of masonry blocks stacked to form a wall.

9 Claims, 3 Drawing Sheets

REBAR POSITIONING DEVICE

CROSS-REFERENCE TO RELATED ART

This application claims the benefit of U.S. Provisional Application No. 63/465,781 filed May 11, 2023.

BACKGROUND

Technical Field

The present invention relates generally to construction equipment and more particularly relates to a device for retaining and positioning rebar being placed in internal openings in masonry blocks in preparation for pouring grout in the block to make a monolithic wall.

Description of Related Art

Many retaining walls are built using stacked rows of masonry blocks. Rebar is inserted in horizontal and vertical spaces formed by the rows of masonry blocks and grout is poured into the spaces to form a monolithic structure. Unfortunately, placement of the rebar is time consuming and can result in uneven disposition of the rebar with respect to the surrounding edges of the blocks which compromise integrity of the bond formed by grout pouring in the blocks. If it is desired to space rebar at fixed distances from each other or from the interior edges of the blocks, spacers or blocks must be manufactured or the bars must be tied in a desired pattern, or both, frequently manufacturing the spacers on site. It is therefore needed to find a solution which reduces the time and materials required to install and fix in place rebar in masonry block walls.

DETAILED DESCRIPTION OF THE ILLUSTRATED EMBODIMENT

Figure 1:
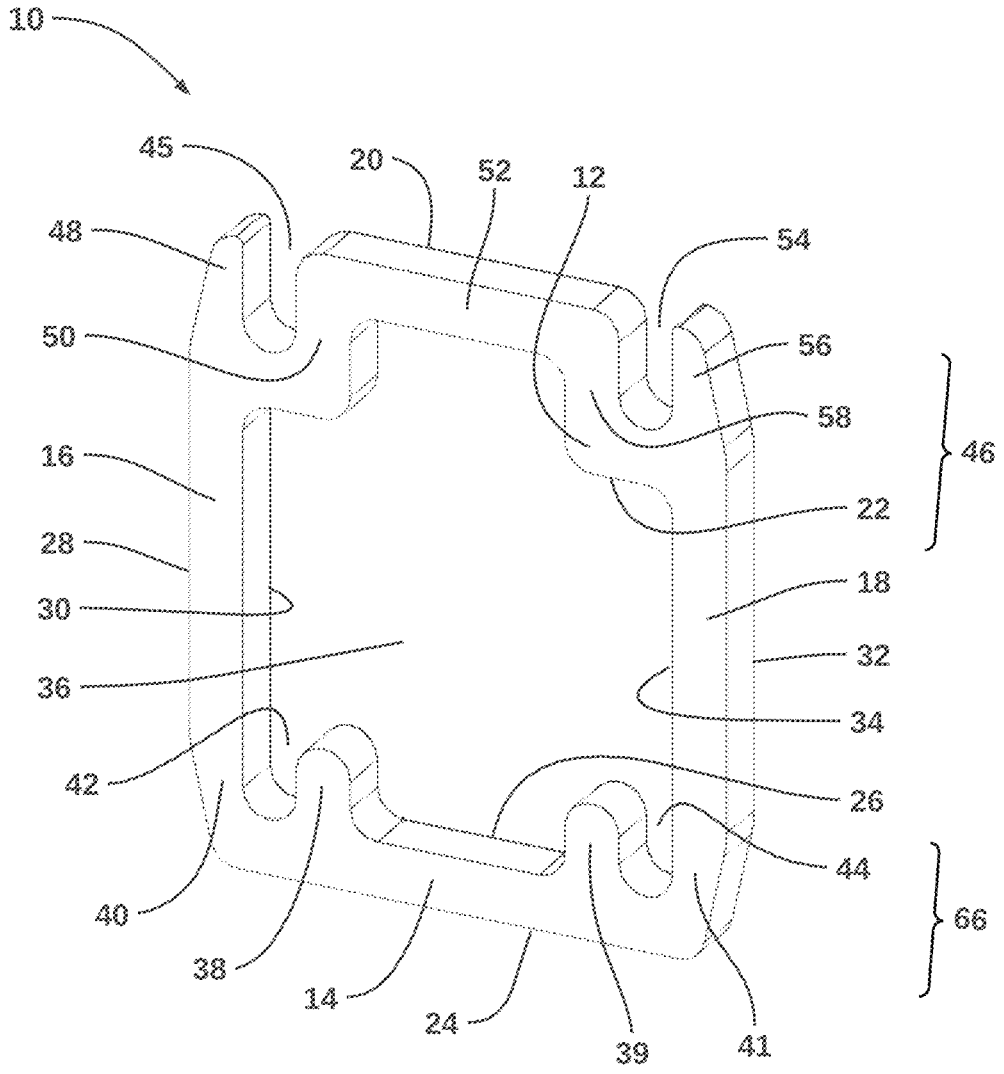
FIG. 1 is a perspective view of a rebar positioning device according to the invention.
Figure 2:
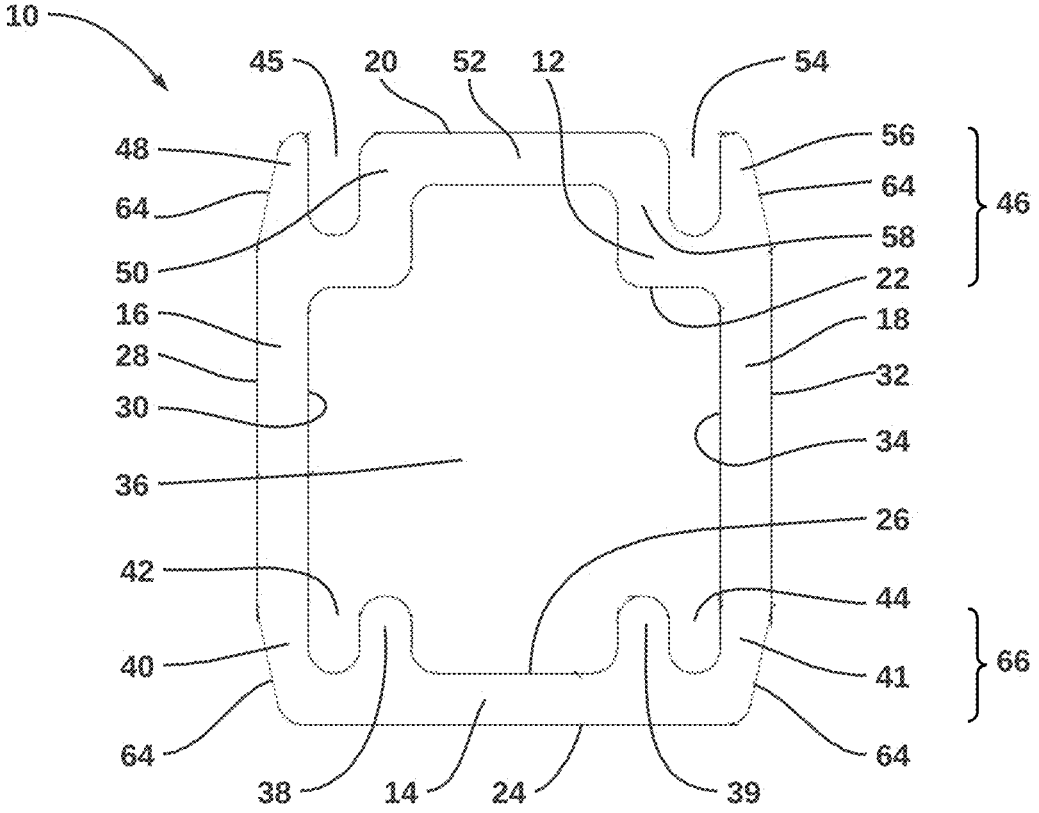
FIG. 2 is a front elevational view thereof.

A rebar positioning device 10 according to the invention is described in detail with respect to FIGS. 1 and 2. The device has a generally planar shape, and it is anticipated will be constructed from a light material that can withstand being embedded in grout yet is sturdy enough to hold lengths of rebar. A suitable material for making the device is rubber, but other materials are to be expected.

The rebar positioning device 10 has a generally rectangular shape having top and bottom horizontal cross bars 12, 14 and left and right vertical side bars 16, 18 extending between the top and bottom cross bars. The top bar is defined by top outer edge 20 and top inner edge 22 and the bottom bar is defined by bottom outer edge 24 and bottom inner edge 26. The left side bar 16 is defined by left outer edge 28 and left inner edge 30 and the right side bar 18 is defined by right outer edge 32 and right inner edge 34. The top, bottom, left and right inner edges, 22, 26, 30 34 bound a large center opening 36.

Left and right inner and outer retention bars 38, 39, 40, 41 extend upwardly from the bottom inner edge 26. The lower left inner retention bar 38 is spaced from the left outer retention bar 40 to form a lower left channel 42. Similarly, the lower right inner retention bar 39 is spaced from the lower right outer retention bar 41 to form a lower right channel 44.

An upwardly opening upper left channel 45 is formed in an upper portion 46 of the device, bounded on the left by top left outer retention bar 48 and on the right by top inner retention bar 50. Similarly, an upwardly opening upper right channel 54 is formed in the upper portion 46 of the device opposite the upper left channel 45, the upper right channel 54 being bounded on the right by top right outer retention bar 56 and, on the left, by top right inner retention bar 58.

Each of the upper left, upper right, lower left and lower right channels 44, 54, 42, 44 are sized to receive rebar of the kind typically used for embedment in grout. In one embodiment of the invention, some or all of the channels are deep enough to accept two overlaying lengths of rebar.

Figure 3:
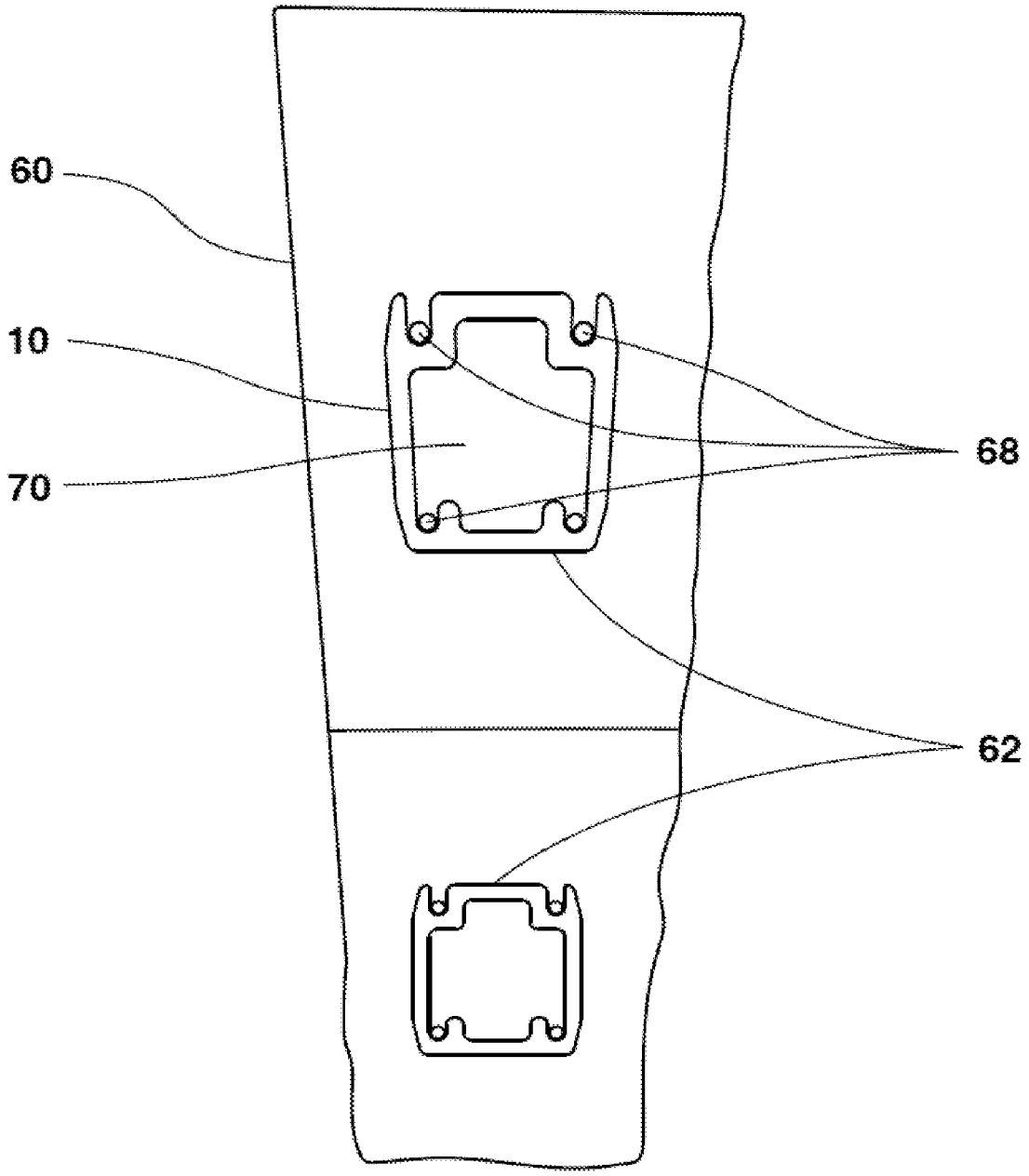
FIG. 3 is a depiction of a slice of a wall formed using masonry blocks in which the rebar positioning device has been installed to place rebar in the masonry blocks.

The device is used during construction of a wall made from hollow masonry blocks 60 as seen in FIG. 3. During construction blocks are dry-stacked in rows and the rebar positioning devices are placed in the hollow openings 62 in the masonry units as shown. To aid in insertion, the outer edges 64 (see FIG. 2) of the top outer retention bars 48, 56 and of the lower retention bars 40, 41 are tapered. When the blocks are stacked in a desired configuration rebar 68 is inserted in the interior openings of the blocks and placed in the channels of the rebar positioning device as shown. The device secures the rebar in the openings of the block well-spaced apart from each other and from the interior edges of the openings in the block so that, when it is poured, grout will surround the rebar, freely adhere to the interior edges of the openings, and improve the strength of the bond formed when the rebar-embedded grout hardens. Moreover, using the rebar position device saves time and provides guidance to installers.

There have thus been described and illustrated certain embodiments of a rebar positioning device according to the invention. Although the present invention has been described and illustrated in detail, it should be clearly understood that the disclosure is illustrative only and is not to be taken as limiting, the spirit and scope of the invention being limited only by the terms of the appended claims and their legal equivalents.

I claim:

1. A rebar positioning device comprising:

a generally planar body sized to fit in the interior opening of a masonry block, the body having top left, top right, bottom left and bottom right portions, a horizontal top cross bar extending between and connecting said top left and top right portions, a horizontal bottom cross bar extending between and connecting said bottom left and bottom right portions, said top cross bar having opposite left and right end portions and a middle portion between said end left and right portions, one or more vertical left side bars extending between and connecting said top left and bottom left portions, and one or more vertical right side bars extending between and connecting said top right and bottom right portions, and said top left portion having an upwardly extending top left retention bar, said top right portion having an upwardly extending top right retention bar, said bottom left portion having an upwardly extending bottom left retention bar, and said bottom right portion having an upwardly extending bottom right retention bar, each of said top left and top right retention bars having an upper end, the middle section of said top cross bar extending between the upper ends of said top left and top right retention bars, said top left retention bar spaced from one of said one or more left side bars forming an upwardly extending top left retention channel, said top right retention bar spaced from one of said one or more right side bars forming an upwardly extending top right retention channel, said bottom left retention bar spaced from one of said one or more left side bars forming an upwardly extending bottom left retention channel, and said bottom right retention bar spaced from one of said one or more right side bars forming an upwardly extending bottom right retention channel, and said retention channels sized to receive, secure and position one or more lengths of rebar that have been inserted in the interior opening of the masonry block in spaced apart disposition in preparation for grouting.

2. The rebar positioning device of claim 1 further comprising:

each of said top left and top right retention bars having a lower end, the left portion of said top cross bar extending between said left side bar and the lower end of said top left retention bar, and the right portion of said top cross bar extending between said right side bar and the lower end of said top right retention bar.

3. The rebar positioning device of claim 1 further comprising:

said top left and top right retention channels horizontally spaced apart and said bottom left and bottom right channels horizontally spaced apart and said top left and top right retention channels vertically spaced apart from said bottom left and bottom right retention channels.

4. The rebar positioning device of claim 1 further comprising:

said top right and top left retention bars each having a lower end, said lower ends spaced apart, and said top left and top right retention bars and said middle portion defining a top recess.

5. The rebar positioning device of claim 1 further comprising:

said bottom left and bottom right retention bars each having an upper end, said upper ends spaced apart, said bottom left and bottom right retention bars and a middle portion of said bottom cross bar defining a bottom recess.

6. The rebar positioning device of claim 1 further comprising:

said middle portion of said bottom cross bar extending between said bottom left and bottom right retention bars.

7. The rebar positioning device of claim 1 further comprising:

at least one of said retention channels sized to receive two or more lengths of rebar.

8. A rebar positioning device comprising:

a generally planar body sized to fit in the interior opening of a masonry block, the body having top left, top right, bottom left and bottom right portions, a horizontal top cross bar extending between and connecting said top left and top right portions, a horizontal bottom cross bar extending between and connecting said bottom left and bottom right portions, said top cross bar having opposite left and right end portions and a middle portion between said end left and right portions, one or more vertical left side bars extending between and connecting said top left and bottom left portions, and one or more vertical right side bars extending between and connecting said top right and bottom right portions, and said top left portion having an upwardly extending top left retention bar, said top right portion having an upwardly extending top right retention bar, said bottom left portion having a bottom left retention bar extending upward from said bottom crossbar, said bottom right portion having a bottom right retention bar extending upward from said bottom crossbar, each of said top left and top right retention bars having an upper end, the middle section of said top cross bar extending between the upper ends of said top left and top right retention bars, said bottom cross bar having opposite left and right end portions and a middle portion between said left and right end portions, each of said bottom left and bottom right retention bars having a lower end, the middle portion of said bottom cross bar extending between the lower ends of said bottom left and bottom right retention bars, each of said top left and top right retention bars having a lower end, the left portion of said top cross bar extending between said left side bar and the lower end of said top left retention bar, and the right portion of said top cross bar extending between said right side bar and the lower end of said top right retention bar, said top right and top left retention bars each have a lower end, said lower ends spaced apart, said top left and top right retention bars and said middle portion defining a top recess, said top left retention bar spaced from one of said one or more left side bars forming an upwardly extending top left retention channel, said top right retention bar spaced from one of said one or more right side bars forming an upwardly extending top right retention channel, said bottom left retention bar spaced from one of said one or more left side bars forming an upwardly extending bottom left retention channel, said bottom right retention bar spaced from one of said one or more right side bars forming an upwardly extending bottom right retention channel, and said retention channels sized to receive, secure and position one or more lengths of rebar that have been inserted in the interior opening of the masonry block in spaced apart disposition in preparation for grouting.

9. A rebar positioning device comprising:

a generally planar body sized to fit in the interior opening of a masonry block, the body having top left, top right, bottom left and bottom right portions, a horizontal top cross bar extending between and connecting said top left and top right portions, a horizontal bottom cross bar extending between and connecting said bottom left and bottom right portions, said top cross bar having opposite left and right end portions and a middle portion between said end left and right portions, one or more vertical left side bars extending between and connecting said top left and bottom left portions, and one or more vertical right side bars extending between and connecting said top right and bottom right portions, and said top left portion having an upwardly extending top left retention bar, said top right portion having an upwardly extending top right retention bar, said bottom left portion having a bottom left retention bar extending upward from said bottom crossbar, said bottom right portion having a bottom right retention bar extending upward from said bottom crossbar, each of said top left and top right retention bars having an upper end, the middle section of said top cross bar extending between the upper ends of said top left and top right retention bars, said top right and top left retention bars each having a lower end, said lower ends spaced apart, said top left and top right retention bars and said middle portion defining a top recess, said bottom cross bar having opposite left and right end portions and a middle portion between said end left and right portions, each of said bottom left and bottom right retention bars having a lower end, the middle portion of said bottom cross bar extending between the lower ends of said bottom left and bottom right retention bars, each of said top left and top right retention bars having a lower end, the left portion of said top cross bar extending between said left side bar and the lower end of said top left retention bar, and the right portion of said top cross bar extending between said right side bar and the lower end of said top right retention bar, said top left retention bar spaced from one of said one or more left side bars forming an upwardly extending top left retention channel, said top right retention bar spaced from one of said one or more right side bars forming an upwardly extending top right retention channel, said bottom left retention bar spaced from one of said one or more left side bars forming an upwardly extending bottom left retention channel, said bottom right retention bar spaced from one of said one or more right side bars forming an upwardly extending bottom right retention channel, said top left and top right retention channels horizontally spaced apart and said bottom left and bottom right channels horizontally spaced apart, and said top left and top right retention channels vertically spaced apart from said bottom left and bottom right retention channels, and said retention channels sized to receive, secure and position one or more lengths of rebar that have been inserted in the interior opening of the masonry block in spaced apart disposition in preparation for grouting.

* * * * *